United States Patent [19]

Day et al.

[11] 4,111,252

[45] Sep. 5, 1978

[54] METHOD FOR MAKING MOLDS AND MOLD COMPONENTS FOR CASTING SINGLE CRYSTAL METALLIC ARTICLES

[75] Inventors: Edward G. Day, Rocky Hill; Edmund Dziobek, Terryville, both of Conn.

[73] Assignee: United Technologies Corporation, Hartford, Conn.

[21] Appl. No.: 820,659

[22] Filed: Aug. 1, 1977

[51] Int. Cl.[2] ..... B22C 9/04; B22C 7/00; B22D 15/02

[52] U.S. Cl. ..... 164/23; 164/34; 164/44; 164/60; 164/45; 164/35

[58] Field of Search ..... 164/14, 23–26, 164/34, 35, 44, 45, 60, 75, 127, 132, 235, 236, 361

[56] References Cited

U.S. PATENT DOCUMENTS

| | | | |
|---|---|---|---|
| 2,770,859 | 11/1956 | Henry | 164/44 |
| 3,461,949 | 8/1969 | Nilson | 164/44 |
| 3,598,172 | 8/1971 | Copley | 164/60 |

*Primary Examiner*—Francis S. Husar
*Assistant Examiner*—K. Y. Lin
*Attorney, Agent, or Firm*—Edward J. Timmer

[57] ABSTRACT

Disclosed is an improved method for making molds and mold components for use in casting single crystal articles. According to the improved method, a preformed and reusable replica of a mold growth cavity and crystal selector passage is provided, the replica including a cylinder in the form of the desired growth cavity and a helical strand in the form of the desired crystal selector passage, one end of the strand being attached to an end of the cylinder such that their axes are coincident. In one embodiment, the replica is coated with a thin layer of wax or other removable material and then utilized in a variety of mold making processes, including investment molding, to form a growth zone and helical crystal selector in the mold. After mold making, the embedded replica is removed from the mold by first removing the thin layer of wax to provide a clearance space between the replica and mold and then rotating the cylinder to unscrew the helical strand from the mold in the same manner that a threaded member is removed from a threaded hole. The replica is then reused to produce additional molds or mold components having a reproducible growth zone and helical crystal selector therein.

9 Claims, 4 Drawing Figures

FIG. 1
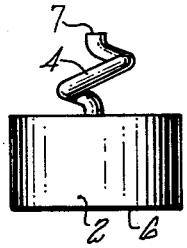
FIG. 2
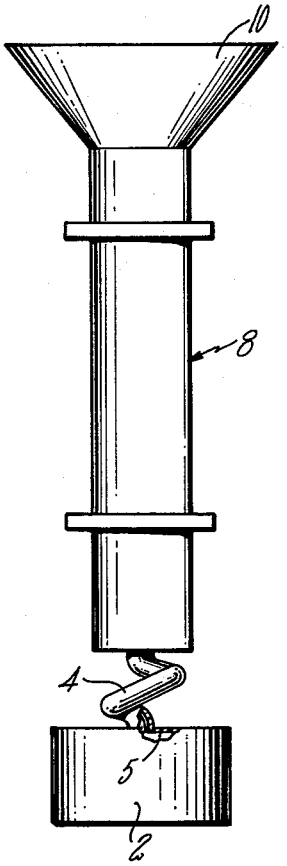
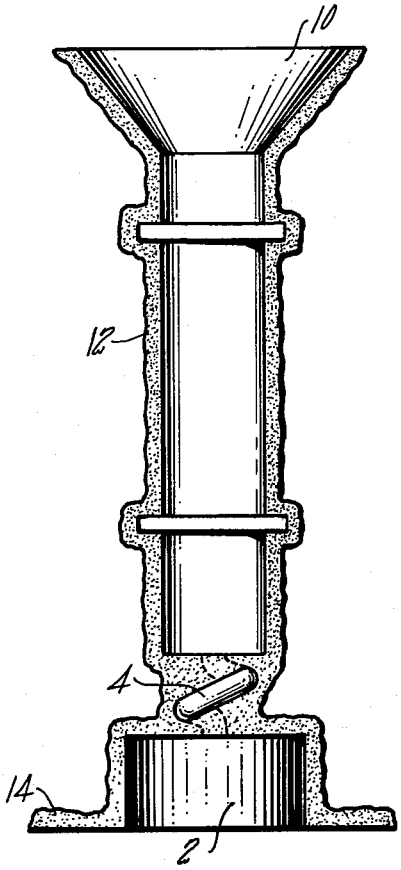
FIG. 3
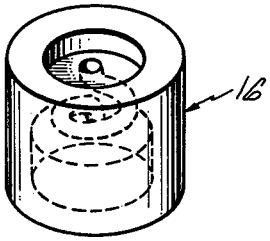
FIG. 4

METHOD FOR MAKING MOLDS AND MOLD COMPONENTS FOR CASTING SINGLE CRYSTAL METALLIC ARTICLES

BACKGROUND OF THE INVENTION

1. Field of the Invention

The present invention is related to methods for making molds and mold components for use in casting single crystal metallic articles.

2. Description of the Prior Art

In casting single crystal metallic articles, a mold having a crystalline growth zone or cavity at the lower end and a narrow passage above and in communication with the growth zone is widely used as, for example, in the Piearcey patent, U.S. Pat. No. 3,494,709 of common assignee herewith. Generally, the mold growth zone has an open bottom so that when the mold is placed on a chill plate during casting, the molten metal therein will be unidirectionally solidified to cause columnar grain growth toward the passage. The narrow passage functions to select a single crystal from among the numerous crystals growing upwardly through the mold. In the past, it has been common for the passage to take the form of a helix of small cross-section as compared to the growth cavity, such a passage being illustrated in U.S. Pat. Nos. 3,625,275; 3,627,015; 3,667,533; 3,690,368; 3,700,023 and 3,712,368, all of common assignee with the present invention.

In one prior art practice, the molds used in single crystal casting are made by the well known shell molding or "lost wax" process in which layers of ceramic material are deposited on a disposable pattern such as a wax pattern. The wax pattern generally comprises an article portion, a helix portion and a growth zone portion, the helix portion being wax welded by hand between the others. It is the assembled wax portions which are then covered with the ceramic layers to form a shell mold therearound. After the desired thickness of ceramic shell is deposited, the wax pattern is melted out, leaving behind a ceramic shell mold having an upper article cavity connected to a lower growth cavity by a helical passage of small cross-section.

As a result of the small cross-section and consequent structural weakness of the wax helix, problems have arisen during assembly of the wax pattern portions and during shell molding in the form of distortion or breakage of the helix. These problems require operating personnel to use utmost care in these operations; however, notwithstanding such care, distortion and breakage of the helix occur all too frequently and result in lower production and increased casting costs.

In another prior art practice, molds for casting single crystals are provided by assembling a precast central mold element on strongback between precast outer mold elements as shown in detail in the Hayes and Phipps patent, U.S. 3,965,963 of common assignee herewith. In this method, the mold elements are preformed or precast by injecting ceramic slurry into a suitably configured molding cavity.

SUMMARY OF THE INVENTION

The present invention provides an improved method for making molds and mold components for casting single crystal metallic articles.

An important feature of the invention is a preformed and reusable replica of a mold growth cavity and a crystal selector passage which replica can be used in a variety of processes to produce molds and mold components having a reproducible growth zone - crystal selector configuration therein. Typically, the replica includes a cylinder of predetermined size for the mold growth zone and a helical strand suitably sized and configured to form a helical crystal selector passage in the mold or mold component, the strand having a small cross-section as compared to that of the cylinder and having one end attached to an end of the cylinder such that the axis of the helix is substantially coincident with that of the cylinder. As explained below, it is important that the axes of the helical strand and cylinder be substantially coincident to insure easy removal of the replica from the formed mold. Preferably, to provide optimum structural strength and service life, the replica is fabricated from metallic members such as, for example, an aluminum cylinder and an aluminum helical strand welded in the prescribed axial relationship to one end of the cylinder.

The replica can be used in a wide variety of mold making processes. According to one embodiment of the invention, the replica is used in conjunction with the investment molding process to produce an open ended mold for single crystal casting, the mold including a growth zone or cavity at its lower end and a helical crystal selector passage leading upwardly from the growth zone to an article cavity. As is usual in the prior art, the mold growth zone is open at the bottom to expose the molten metal therein to the chill plate during casting. In this embodiment, the replica is first coated with a thin layer of removable material such as wax and the coated replica is then joined to the lower end of a disposable pattern of the article to be cast. Preferably, joining is effected by placing the wax coated replica in a suitably shaped mold and injecting a wax pattern of the article thereagainst, the pattern being formed and attached to the replica in the same operation. Thereafter, ceramic material, such as ceramic slurry, is deposited on the structure of replica and wax pattern until the desired thickness for a mold wall is obtained. Since the mold is to have an open bottom, it is preferable that no ceramic be deposited on the end of the cylinder opposite the helical strand. The embedded replica is then removed from the formed mold in essentially two steps. First, the thin layer of wax or other disposable material is removed from the embedded replica to provide a clearance space between the replica and ceramic mold. Then, the exposed end of the cylinder is rotated to unscrew the helical strand from the mold in the same manner that a threaded member is removed from a threaded hole. To insure satisfactory unscrewing of the helix from the shell mold, it is important that the prescribed axial relationship between the helical strand and cylindrical body be provided. After removal, the replica can be reused in making other molds.

In another embodiment of the invention, the preformed replica can be used in somewhat similar fashion in ceramic injection processes to make a ceramic crystal selector insert which, in conjunction with other preformed ceramic mold components, provides a complete mold for casting single crystal articles.

Or, alternately, the replica may be constructed such that the helical strand is tapered to provide a gradually increasing cross-section toward the cylinder and this replica used in ceramic injection processes without the need for initially wax coating the replica. Removal of such replica is effected by rotating the exposed end of the cylinder as above, the taper or draft on the helical strand permitting easy unscrewing of the strand from the formed insert.

These and other advantages and objects of the invention will become more fully apparent from the following drawings and detailed description of the preferred embodiments.

BRIEF DESCRIPTION OF THE DRAWINGS

FIG. 1 is a side elevation of a replica of a mold growth zone and helical crystal selector.

FIG. 2 is a side elevation of the wax coated replica joined to a disposable pattern of a turbine blade.

FIG. 3 is the structure of FIG. 2 after investment shell molding, the ceramic shell being broken away to reveal the replica and pattern.

FIG. 4 is a perspective view of a ceramic crystal selector insert made by the inventive method.

DESCRIPTION OF THE PREFERRED EMBODIMENT

Referring now in detail to the present preferred and illustrative embodiments of the invention, a preformed and reusable replica of a mold growth zone and helical crystal selector for use in making molds and mold components for casting single crystal metallic articles is shown in FIG. 1. The replica includes right cylinder 2 of predetermined size to form a suitable growth zone or cavity in the mold and a helical strand 4 suitably configured and sized to form a helical crystal selector passage in the mold, one end of the strand 4 being attached to the top end of the cylinder in such a manner that the axis of the helix substantially coincides with the axis of the cylinder. As illustrated, the cross-section of the strand is preferably circular and of small diameter as compared to that of the cylinder. It is important that the radius of curvature of the helix be greater than the radius of the strand itself so that there is no possibility for direct vertical growth of a crystal from the growth zone through the helical passage. Although not essential to the invention, it is preferred that the replica be constructed of metallic members, for example, an aluminum cylinder and aluminum helical strand welded to the end of the cylinder, as shown in FIG. 1, have proved very durable and free of significant distortion after extensive use in making molds and mold components. Minimization of distortion of the replica, especially the helical strand, is highly important since selection and growth of a single metallic crystal can be adversely affected by minor dimensional changes in the helix. Those skilled in the art will recognize, however, that other materials may find use in fabricating such replicas including, but not limited to, plastic, ceramic, wood and the like. Since the replica can be readily made to very close tolerance, it is apparent that the growth zone and helical crystal selector in the mold can likewise be provided to very close tolerance. This precise control ensures that crystal selection is optimized from one mold to the next during casting.

The preformed and reusable replica can be used in a variety of mold making processes such as investment molding including the "lost wax" process, high and low pressure ceramic injection processes, and the like. Regardless of the mold making process utilized, the first step in one embodiment of the invention is to coat the replica with a thin layer 5 of removable material such as low melting point wax. If wax is used, a layer of $\frac{1}{8}$ inch thickness has been found satisfactory. Since the bottom of the mold growth zone is to be open, the end 6 of the right cylinder is preferably covered by a flat plate which can be easily removed after investment molding.

In investment molding processes, the wax coated replica is then joined to a disposable pattern or patterns of the article to be cast. The pattern is typically wax and can be united with the replica in a number of ways, including manual assembly. A preferred technique, however, is to expose the end 7 of the strand opposite the cylinder to a suitable pattern molding cavity and inject molten wax therein against end 7 to not only form the pattern but also unite it with the replica as the wax solidifies. A typical injected structure is shown in FIG. 2 and comprises the wax coated replica, including cylinder 2 and helical strand 4, and pattern 8 which, by way of illustration, is shown as a turbine blade having a pour cup 10 attached to the top portion. Thereafter, the united structure of replica and pattern is invested in ceramic to form a mold therearound. In the "lost wax" or shell investment process, the structure is repeatedly dipped in ceramic slurry and dusted with ceramic particulate to form a ceramic shell 12 thereon, FIG. 3, the mold being shown with a base or flange portion 14 which rests on the chill plate (not shown) during casting. Since the mold is to have a growth zone with an open bottom, preferably no ceramic is deposited on the end 6 of cylinder 2 opposite the helical strand. Deposition is prevented if the end is covered by the flat plate already mentioned. In the solid investment molding process, the united structure is surrounded by a flask or other suitable container and ceramic mold slurry is poured into the flask around all but the end 6 of the cylinder. In either investment process, after the ceramic material hardens, the replica is removed to provide the desired growth zone and helical crystal selector passage in the mold.

Removal of the embedded replica is effected in two steps including first removing the thin layer of wax or other disposable material on the replica to provide a clearance space between the replica and ceramic mold and then rotating the exposed end of the cylinder to unscrew the helical strand from the mold in the same manner that a screw or other threaded member is removed from a threaded hole. It is essential for easy removal without damage to either the mold or the replica that the axis of the helix be substantially coincident with the axis of the right cylinder. During or after replica removal, the pattern 8 having pour cup 10 is removed to provide a ceramic mold for casting single crystal metallic articles. Removal of the wax layer and pattern is accomplished by conventional means such as heating, microwave dewaxing, dissolution and the like. Of course, the replica can thereafter be used in making additional molds for casting.

It is also possible to use the preformed replica to make a mold component such as a ceramic crystal selector insert which, in conjunction with other preformed mold mold components, provides a complete mold for casting single crystal objects. Such an insert can be made by placing the wax coated replica in a ceramic injection mold of suitable shape and at high pressure or low pressure injecting ceramic slurry into the mold around the replica, except for end 6. Thereafter when the ceramic hardens, the replica is removed by the two step process described hereinabove. The resultant ceramic crystal selector insert 16 of FIG. 4 can then be combined with mold elements like those discussed in the Hayes and Phipps patent, U.S. Pat. No. 3,963,965, to provide a complete mold for casting single crystal articles. In such a case, the thickness of the ceramic insert in the area of the helix and growth zone can be increased to provide an insulating effect to improve the thermal gradient and minimize spurious grain nucleation. Alternately, the ceramic crystal selector insert can be united in a pattern mold with a wax or other disposable pattern of the article to be cast and the structure of insert and pattern then invested in ceramic to form a mold therearound, such a technique being described in the copending application entitled "Single Crystal Casting Mold and Method for Making Same" by Douglas R. Hayes. Again, removal of the replica from the formed mold is as described hereinabove.

In another embodiment of the invention, the replica is constructed such that the helical strand exhibits a gradually increasing cross-section from end 7 toward the cylinder 2. This taper or draft permits the replica to be utilized in mold making processes, especially ceramic injection processes, without the need for first coating the replica with the thin layer of wax. After the mold component is formed, the replica is removed as described above by rotating the exposed end 6 of the cylinder, the draft on the helical strand permitting ready unscrewing of the strand from the component. The formed mold component can then be used in conjunction with other preformed components or united with a wax pattern as described above.

It is now apparent that the present invention is capable of providing large numbers of molds and mold components having a reproducible growth zone and helical crystal selector therein for casting single crystal articles. This feature is highly advantageous in producing large numbers of single crystal castings with automated foundry equipment and techniques since overall quality is improved while, at the same time, manual operations and mold and casting rejections are reduced to lower casting costs.

Although the invention has been shown and described with respect to illustrative embodiments thereof, it will be understood by those skilled in the art that changes and additions in the form and detail thereof may be made without departing from the spirit and the scope of the invention.

We claim:

1. In making ceramic mold means for casting single crystal metallic articles, the improvement comprising:

(a) providing a preformed and reusable replica of a mold growth cavity and crystal selector passage, said replica including a cylinder of predetermined size to form said growth cavity and a helical strand of preselected configuration to form said crystal selector passage, the strand having a small cross-section compared to that of the cylinder and having one end attached to one end of the cylinder such that the longitudinal axis of the helix is substantially coincident with that of the cylinder;

(b) coating the replica with a thin layer of removable material and then forming at least a portion of the ceramic mold means around the coated replica, leaving the other end of the cylinder opposite the helical strand exposed;

(c) removing the embedded replica from the formed mold means to provide the growth cavity and crystal selector passage therein, removal being effected by first removing the thin layer of removable material to provide a clearance space between the replica and mold means and then rotating the exposed end of the cylinder to unscrew the helical strand from the mold means in the same manner that a threaded member is removed from a threaded hole, the replica thereafter being available for reuse in making additional mold means.

2. The method of claim 1 wherein the mold means is formed by investment molding.

3. The method of claim 1 wherein the mold means is formed by injecting ceramic material around the replica while the replica is held in a molding cavity.

4. The method of claim 1 wherein the replica is fabricated from a metallic cylinder and helical strand, the strand being welded to the end of the cylinder.

5. The method of claim 1 wherein the removable material covering the replica is wax.

6. The method of claim 5 wherein the wax is removed from the replica by melting.

7. In making ceramic mold means for casting single crystal metallic articles, the improvement comprising:

(a) providing a preformed and reusable replica of a mold growth cavity and crystal selector passage, said replica including a cylinder of predetermined size to form the growth cavity and a helical strand of preselected configuration to form the crystal selector passage, the strand having one end attached to the one of the cylinder such that the longitudinal axis of the helix is substantially coincident with that of the cylinder and having a small cross-section compared to that of the cylinder, the cross-section of the strand gradually increasing toward the cylinder;

(b) forming at least a portion of the ceramic mold means around the replica, leaving the other end of the cylinder opposite the helical strand exposed; and (c) removing the embedded replica from the formed mold means to provide the growth cavity and crystal selector passage therein, removal being effected by rotating the exposed end of the cylinder to unscrew the helical strand from the mold means in the same manner that a threaded member is removed from a threaded hole, the tapered cross-section of the strand facilitating the unscrewing of the strand, said replica thereafter being available for reuse in making additional mold means.

8. The method of claim 7 wherein the mold means is formed by injecting ceramic material around the replica while the replica is held in a molding cavity.

9. The method of claim 7 wherein the replica is fabricated from a metallic cylinder and helical strand, the strand being welded to the end of the cylinder.

* * * * *